United States Patent [19]

Capper

[11] Patent Number: 5,016,291

[45] Date of Patent: May 21, 1991

[54] NAPPED ELASTIC WAISTBAND

[76] Inventor: Montague Capper, 7539 Madora Ave., Canoga Park, Calif. 91306

[21] Appl. No.: 498,402

[22] Filed: Mar. 26, 1990

[51] Int. Cl.[5] ..... A41F 9/00

[52] U.S. Cl. ..... 2/312; 2/221; 2/237

[58] Field of Search ..... 2/311, 312, 236, 237, 2/220, 221, 321, 322, 338

[56] References Cited

U.S. PATENT DOCUMENTS

| | | | |
|---|---|---|---|
| 1,469,858 | 10/1923 | VanHusen | 2/220 |
| 2,353,567 | 7/1944 | Key | 2/312 |
| 2,632,894 | 3/1953 | Louis | 2/312 |
| 2,663,027 | 12/1953 | Posson | 2/312 |
| 4,836,194 | 6/1989 | Schastian et al. | 2/338 |

OTHER PUBLICATIONS

International Publication No. WO 88/00011, Jan. 1988, Collins, Richard, "An Infant's Napkin Securing Device".

*Primary Examiner*—Werner H. Schroeder
*Assistant Examiner*—Amy Brooke Vanatta

[57] ABSTRACT

A waistband is disclosed herein for use in maintaining articles of clothing in place while being worn, and which includes an elongated waistband having tufted or napped surfaces on opposite sides thereof for frictional engagement with the clothing. Opposing opposite ends of the waistband include a hook and pile closure for adjustment to the wearer and for releasable fastening of the waistband.

1 Claim, 1 Drawing Sheet

FIG. 1.
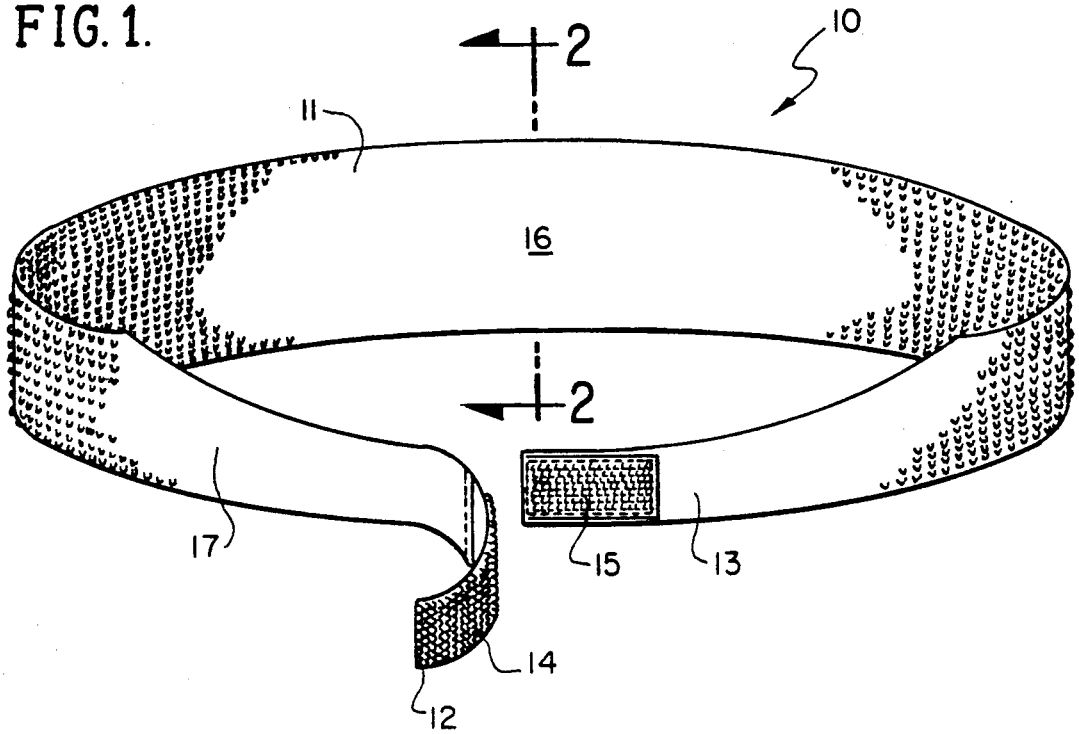
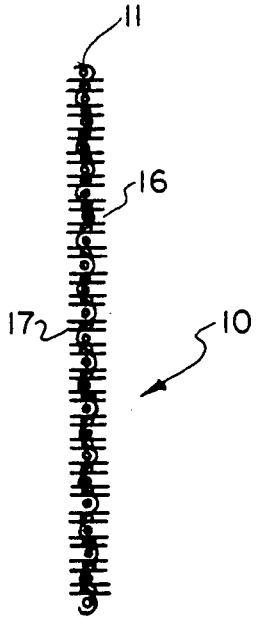
FIG. 2.

NAPPED ELASTIC WAISTBAND

BACKGROUND OF THE INVENTION

1. Field of the Invention

The present invention relates to the field of garment or clothes retainers, and more particularly to a novel waistbelt useful in maintaining the wearer's clothes in place so as to prevent inadvertent dislodgement or displacement of clothing as it is worn.

2. Brief Description of the Prior Art

In the past, numerous problems and difficulties have been encountered by both men and women when wearing separate clothing such as shirts and pants for a man and blouses and skirts for a woman. These problems stem largely from the fact that as the wearer moves and manipulates his or her body, the shirt or blouse has a tendency to "ride" or substantially move with respect to the pant, trousers or skirt so that in many instances, the shirt or blouse will have a disheveled and unsightly look due to unwanted excess of material outside of the pant, trouser or skirt.

One attempt has been made to maintain or retain the shirt or blouse in proper position with respect to a trouser or skirt which includes tufted material placed on the inside waist portion of the trousers or skirt so that it will provide a frictional engagement with the surface of the shirt or blouse against which it bears. However, such a construction of the trouser or skirt is expensive and must be done by the original manufacturer. In those instances where no such frictional means has been originally provided in the garment, the above-noted problem still exists. Also, a single waistbelt having a friction surface on one side has been used and has been proven inoperative and unacceptable for its intended purpose since the smooth side of the belt permits unwanted gathering of the material or pulling out of the material from the waistband of the trouser or skirt.

Therefore, a long-standing need has existed to provide a novel waistband which may be worn between the inside waist portion of a trouser or skirt and the outside portion of a shirt or blouse so that the shirt or blouse will not gather or ride out of position as the wearer moves his or her body about. Such a retainer must be operable whether the composition of the shirt or blouse is of a cotton, wool or slippery silk material.

SUMMARY OF THE INVENTION

Accordingly, the above problems and difficulties are obviated by the present invention which provides a novel waistband having opposite ends releasably connected together via a hook and pile closure means so that the waistband can be readily adjusted to accommodate the girth of the wearer. A special feature of the present invention provides that the opposite sides of the elongated waistband be napped or tufted so as to provide frictional surfaces that will simultaneously engage with the inside waist portion of a trouser or skirt and with the outside surface of a shirt or a blouse. The tufted or napped surfaces on opposite sides of the waistband constitute a frictional surface by providing a plurality of spaced-apart nubs which may be of either a hooked or a pile nature wherein there will be no damage to the material of the garment and yet sliding resistance will be provided.

Therefore, it is among the primary objects of the present invention to provide a novel retaining means for resisting displacement of adjacent garments, such as shirts and blouses, with respect to trousers and skirts, so that movement of the wearer will not displace the garments with respect to each other.

Another object of the present invention is to provide a novel waistband having opposite surfaces which include frictional means for simultaneously engaging with opposing surfaces of garments worn by a wearer in order to prevent displacement of the garments with respect to each other.

Another object of the present invention is to provide a simple and inexpensive means for preventing shirt or blouse displacement with respect to trousers or skirts by employing a double surface tufted waistband engageable with both the shirt or blouse with the respective trouser or skirt so as to prevent displacement or gathering of material therebetween.

Yet a further object of the present invention is to provide an operable waistband for preventing displacement of garments that are simultaneously worn that would otherwise work themselves separate following the movements of the wearer.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel waistband incorporating the present invention; and FIG. 2 is an enlarged transverse cross-sectional view of the waistband shown in FIG. 1 as taken in the direction of arrows 2—2 thereof.

DESCRIPTION OF THE PREFERRED EMBODIMENT

Referring to FIG. 1, the novel elastic waistband of the present invention is illustrated in the general direction of arrow 10 which includes an elongated band 11 having opposite ends 12 and 13 respectively which may be joined together by a releasable fastening means. In one form of the invention, the releasable fastening means may be of a hook and pile type wherein the hook closure is indicated by numeral 14 and the pile closure of the fastener is indicated by numeral 15. Once the opposing ends 13 and 14 have been joined together, an endless loop or band is provided.

It is to be particularly noted that the band 11 includes opposite surfaces 16 and 17 which are characterized as having a tufted or napped surface constituting frictional means. The illustration shows that the surfaces 16 and 17 are provided with rows and columns of woven-in-place material so that both surfaces 16 and 17 serve as frictional means.

Referring now in detail to FIG. 2, an enlarged sectional view is shown to clearly illustrate that the band 11 includes tufted or napped surfaces 16 and 17. The roughened or irregular surfaces constitute an inner surface 16 and an outer surface 17 so that when worn by the user, the inner surface 16 bears against the shirt or blouse of the wearer, while the outer surface 17 abuttingly engages with the inside of the wearer's trousers or skirt band. The waistband itself is defined as an elastic band which may stretch or contract in order to follow the movements of the wearer's body as the belt is worn. Also, the irregularity of the opposite surfaces is derived from the weave of the belt or band itself and the roughening or friction elements are not separate or individual but are a part of the elastic fabric weave.

In view of the foregoing, it can be seen that when a woman, as an example, places the waistband 10 about her waist over the lower portion of a blouse and further places the waistband of a skirt over the outside of the waistband 10, the waistband serves as a retaining means to prevent slipping of the skirt or the blouse from its originally adjusted position on the wearer. Any pull on the blouse or the skirt will be resisted by the waistband 10 due to the frictional engagement or abutment of the roughened surfaces 16 and 17 against the respective clothing or garments of the wearer. If desired, the waistband 10 may be composed of an elastic knit with a rough edge that may be bent over upon itself and knitted together at the regions of the ends 12 and 13. Also, the closure means may be placed at the back of the wearer or in the front of the wearer at the discretion of the wearer.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a waistband device interposed between garments, as pants and shirt or blouse and skirt, the improvement which comprises:

an elongated band disposed between pants and shirt or blouse and skirt and of elastic fabric having opposite ends and opposite surfaces defined between top and bottom edges;

said opposite surfaces characterized as having a continuous tufted and napped irregular surface texture covering both surfaces providing frictional means separable and engageable with opposing exterior surfaces of garments worn by the user;

said tufted and napped surfaces are woven into said band fabric thereby outwardly extending from both of said opposite surfaces into frictional engagement with the worn garments;

said opposing ends terminate in a reduced width between said top and said bottom edges from the width of the major band length; and said band is flexible and expandable.

* * * * *